US010375991B2

(12) United States Patent
Lipowicz

(10) Patent No.: US 10,375,991 B2
(45) Date of Patent: Aug. 13, 2019

(54) ELECTRONIC INHALATION DEVICE INCLUDING AN ABRASIVE ELEMENT

(71) Applicant: Altria Client Services LLC, Richmond, VA (US)

(72) Inventor: Peter Lipowicz, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 642 days.

(21) Appl. No.: 14/865,229

(22) Filed: Sep. 25, 2015

(65) Prior Publication Data

US 2016/0088874 A1 Mar. 31, 2016

Related U.S. Application Data

(60) Provisional application No. 62/055,269, filed on Sep. 25, 2014.

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 2202/066
See application file for complete search history.

(56) References Cited

U.S. PATENT DOCUMENTS 3,362,405 A * 1/1968 Hazel ..... A61K 9/007 128/203.15
3,831,606 A * 8/1974 Damani ..... A61M 15/0028 128/203.15
4,164,230 A * 8/1979 Pearlman ..... A24F 1/22 131/330
4,436,100 A * 3/1984 Green, Jr. ..... A24F 47/004 110/118
5,176,132 A * 1/1993 Drought ..... A61M 15/0065 128/203.15
5,347,999 A * 9/1994 Poss ..... A61M 15/0065 128/203.15
5,673,685 A * 10/1997 Heide ..... A61M 15/0065 128/203.12
5,687,746 A * 11/1997 Rose ..... A24F 47/002 128/202.21
9,332,879 B1 * 5/2016 Bronson ..... A61M 15/06
2005/0016553 A1 1/2005 Iannuzzi
2008/0276948 A1 11/2008 Gedevanishvili et al.
2010/0319694 A1 * 12/2010 Cook ..... A61M 15/0065 128/203.15

(Continued)

OTHER PUBLICATIONS

International Preliminary Report for International Application No. PCT/US2015/052236 dated Apr. 6, 2017.

(Continued)

*Primary Examiner* — Anthony Calandra
*Assistant Examiner* — Jerzi H Moreno Hernandez
(74) *Attorney, Agent, or Firm* — Harness, Dickey & Pierce, P.L.C.

(57) ABSTRACT

An electronic inhalation device includes an outer housing extending in a longitudinal direction, an air inlet, an outlet, a formulation, and an abrasive element, which contacts a surface of the formulation. The abrasive element is configured to generate a particle cloud from the formulation by removing particles from the formulation and entraining the particles in an air flow.

18 Claims, 8 Drawing Sheets

(56) References Cited

U.S. PATENT DOCUMENTS

| | | | | |
|---|---|---|---|---|
| 2012/0272959 | A1* | 11/2012 | Penskikh | A61M 11/02 128/203.15 |
| 2013/0025608 | A1 | 1/2013 | Fakhouri et al. | |
| 2013/0167853 | A1 | 7/2013 | Liu | |
| 2013/0298905 | A1 | 11/2013 | Levin et al. | |
| 2014/0060554 | A1 | 3/2014 | Collett et al. | |
| 2014/0064715 | A1 | 3/2014 | Greim et al. | |
| 2014/0109899 | A1 | 4/2014 | Boucher et al. | |
| 2014/0186015 | A1 | 7/2014 | Breiwa, III et al. | |
| 2015/0040928 | A1* | 2/2015 | Saydar | A61M 15/00 131/329 |

OTHER PUBLICATIONS

International Search Report PCT/ISA/210 and Written Opinion of the International Searching Authority PCT/ISA/237 for International Application No. PCT/US2015/52236 dated Feb. 4, 2016.

* cited by examiner

ELECTRONIC INHALATION DEVICE INCLUDING AN ABRASIVE ELEMENT

PRIORITY STATEMENT

This application is a non-provisional application that claims priority to U.S. provisional app. No. 62/055,269, filed on Sep. 25, 2014, the entire content of which is incorporated by reference in its entirety.

BACKGROUND

Field

Electronic vaping devices may include a reservoir containing a liquid and a heating element that heats the liquid to form a vapor.

Description of Related Art

Electronic vaping devices may emulate cigarettes, but without the combustion of tobacco. Rather than burning tobacco, a formulation may be vaporized.

SUMMARY

In accordance with some example embodiments, an electronic inhalation device includes an abrasive element configured to abrade a surface of a formulation.

In at least one example embodiment, a cartridge of an electronic inhalation device is provided. The cartridge may include an outer housing extending in a longitudinal direction, an air inlet, an outlet, an airflow path communicating the air inlet and the outlet, a formulation in the outer housing between the air inlet and the outlet, and an abrasive element contacting a surface of the formulation. The abrasive element is configured to abrasively remove particles from the formulation when driven by a driver, such that the particles become entrained in an air stream of the airflow path and form a particle cloud.

In at least one example embodiment, the abrasive element is connected to an abrasion shaft. The abrasion shaft is configured to couple to and be driven by a drive shaft. The abrasion shaft includes an abrasion shaft coupling configured to detachably couple to a drive shaft coupling.

In at least one example embodiment, the cartridge also includes a filter between the formulation and the outlet. The cartridge may also include a biasing element configured to urge the formulation and the abrasive element into contact. The biasing element may include at least one of a spring and an elastic material.

In at least one example embodiment, the abrasive element is formed from stainless steel. The abrasive element may include at least one of a roughened surface, vanes arranged on a surface of the abrasive element, a drill bit, a wire bristle, and wire brush having a drill bit at a leading end portion thereof. The drill bit may include at least one of a twist drill bit, a step drill bit, a core drill bit, and a spade drill bit. The abrasive element may be configured to heat a portion of the formulation by friction, such that a portion of the formulation is vaporized.

In at least one example embodiment, the formulation includes at least one of nicotine, a nicotine salt, a sugar, a sugar alcohol sweetener, nicotine bitartrate, a flavor, a binder, a crystalline acid, and a filler. The formulation may be generally cylindrical. In at least one example embodiment, the formulation may be generally tubular and may include a central airflow passage therethrough. The formulation may include a radial passage in fluid communication with the central airflow passage.

In at least one example embodiment, the formulation includes a protective outer coating, the protective outer coating configured to reduce exposure of the underlying formulation to at least one of humidity and oxygen.

In at least one example embodiment, the cartridge may also include a reclosable loading port configured to allow the formulation to be inserted and removed from the cartridge.

In at least one example embodiment, a power supply component of an electronic inhalation device is provided. The power supply component is configured to connect to a cartridge. The power supply component includes an outer housing extending in a longitudinal direction, a power supply, an abrasive element, and a driver in electrical communication with the power supply. The driver is configured to drive the abrasive element.

In at least one example embodiment, the driver is configured to rotate or oscillate a drive shaft connected to the abrasive element when the driver is powered by the power supply so as to drive the abrasive element. The driver is one of a piezoelectric actuator, a solenoid actuator, and a motor.

In at least one example embodiment, the abrasive element is formed from stainless steel. The abrasive element includes at least one of a roughened surface, vanes arranged on a surface of the abrasive element, a drill bit, a wire bristle, and wire brush having a drill bit at a leading end portion thereof. The drill bit includes at least one of a twist drill bit, a step drill bit, a core drill bit, and a spade drill bit.

In at least one example embodiment, a method of producing a particle cloud from an electronic inhalation device includes abrading a portion of the formulation by driving an abrasive element surface against the surface of the formulation, the frictional force between the abrasive element surface and the surface of the formulation removing particles from the surface of the formulation to form a particle cloud.

In at least one example embodiment, the method includes locally heating the surface of the formulation with the abrasive element to vaporize portions of the surface of the formulation. The particles may have a mass median aerodynamic diameter of about 1 micron to about 10 microns.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
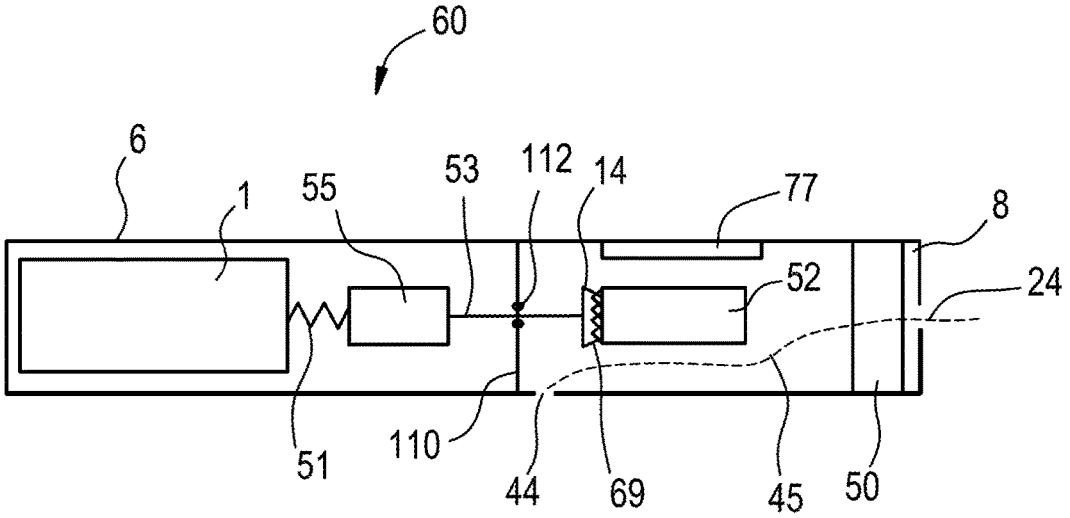
FIG. 1 is a cross-sectional view of an electronic inhalation device according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of example embodiments.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value include a tolerance of ±10% around the stated numerical value.

In at least one example embodiment, an electronic inhalation device may include an abrasive element and a formulation in solid form.

In at least one example embodiment, as shown in FIG. 1, an electronic inhalation device 60 comprises an outer housing 6 extending in a longitudinal direction, an air inlet 44, and an outlet 24. An airflow path 45 is defined between the air inlet 44 and the outlet 24.

In at least one example embodiment, the outer housing 6 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. In at least one example embodiment, the material is light and non-brittle.

In at least one example embodiment, the electronic inhalation device 60 is about the same size as a cigarette. In some example embodiments, the electronic inhalation device 60 may be about 80 mm to about 110 mm long, for example, about 80 mm to about 100 mm long and about 8 mm or greater in diameter. In at least one example embodiment, the electronic inhalation device 60 is about 84 mm long and has a diameter of about 7.8 mm.

In at least one example embodiment, a solid formulation 52 is included between the air inlet 44 and the outlet 24 in the outer housing 6. The outlet 24 may be formed in a mouth-end insert 8.

In at least one example embodiment, the formulation 52 may include volatile ingredients. The formulation 52 may include nicotine and/or a nicotine salt, such as for example, nicotine bitartrate. The formulation 52 may also include a sugar, sugar alcohol sweeteners, flavors, a binder, a crystalline acid, a filler, and/or combinations thereof.

In at least one example embodiment, the ingredients for forming the flavor and taste constituents of the formulation 52 are in liquid form and absorbed in an inert solid substrate, such that the liquid ingredients are dried therein and the formulation 52 is solid.

In at least one example embodiment, the formulation 52 may be a crystalline material or a polymeric material such as a water soluble polymeric material or a glassy polymeric material.

In at least one example embodiment, as shown in FIG. 1, the formulation 52 is a solid, cylindrical body.

In at least one example embodiment, as shown in FIG. 1, the electronic inhalation device 60 includes an abrasive (ablating) element 14 that contacts a surface of the formulation 52. The abrasive element 14 is configured to generate a particle cloud by abrasively (ablatively) removing particles from the formulation 52 when the abrasive element 14 is driven by a driver 55. The driver 55 is configured to drive a drive shaft 53 or other suitable connection with the abrasive element 14 so as to rotate or oscillate the abrasive element 14 when the driver 55 is powered by a power supply 1. The driver 55 may be a motor, a piezoelectric actuator, or a solenoid actuator configured to drive the abrasive element 14.

In at least one example embodiment, particles are generated from the formulation 52 when abraded by the abrasive element. The particles become entrained in the air stream of the airflow path during a puff or draw upon the electronic inhalation device 60 and form a particle cloud.

In at least one example embodiment, the ingredients forming the formulation 52 are ground into a fine powder and compacted to form a solid. The particle size of the powder forming the solid may be greater than the particle size of the particles forming the particle cloud by the abrasive element 14 abrading the formulation 52. In at least one example embodiment, the particle size of the fine powder and the abraded particles may be about the same size.

In at least one example embodiment, as shown in FIG. 1, the formulation 52 is a solid, cylindrical body.

In at least one example embodiment, as shown in FIG. 1, the electronic inhalation device 60 includes a biasing element 51 which is configured to force and/or urge the formulation 52 and the abrasive element 14 into surface-to-surface contact such that sufficient contact between the two surfaces is maintained for particles of the particle cloud to be generated.

In at least one example embodiment, the biasing element 51 may be a spring. In at least one example embodiment, the biasing element 51 may be formed of an elastic material. The biasing element 51 may be in compression and/or in tension and may be operative upon at least one of the abrasive element 14 and the formulation 52.

In at least one example embodiment, as shown in FIG. 1, the abrasive element 14 is formed of stainless steel. The abrasive element 14 may be generally disc-shaped and may include a plurality of teeth on a roughened surface 69 thereof. The roughened surface 69 abrasively removes particles from the formulation 52, such that a particle cloud is generated. The size and number of teeth on the roughened surface may vary depending on the desired particle size of the particle cloud. The teeth may have pointed or rounded edges (not shown).

In at least one example embodiment, as shown in FIG. 1, the electronic inhalation device 60 also includes a filter 50 disposed between the formulation 52 and the outlet 24. The filter 50 is configured to filter (collect) larger particles of the particle cloud which are greater than a desired (or, alternatively a predetermined) size, while allowing more or essentially all of the finer particles to pass. The electronic inhalation device 60 may also include a reclosable loading port 77, which is configured to allow a new formulation 52 to be inserted into the electronic inhalation device 60 when an original formulation 52 has been completely used (depleted).

In at least one example embodiment, the power supply 1 includes a battery. The battery may be a Lithium-ion battery or one of its variants, for example a Lithium-ion polymer battery. In some example embodiments, the battery may be a Nickel-metal hydride battery, a Nickel cadmium battery, a Lithium-manganese battery, a Lithium-cobalt battery or a fuel cell. If the electronic inhalation device 60 is disposable, the electronic inhalation device 60 may be usable until the energy in the power source is depleted. In at least one example embodiment, the power source 1 may be rechargeable and the control circuit 16 is configured to allow the battery to be charged by an external charging device. In the latter case, the power source 1, when charged via the control circuit 16, provides power for a desired (or, alternatively a predetermined) number of puffs (or puff/power cycles), after which the control circuit 16 must be re-connected to an external charging device or source.

In at least one example embodiment, the control circuit 16 is configured to operate the driver 55 for a desired (or, alternatively a predetermined) time period during a puff/power cycle such that the abrasive element 14 is configured to abrasively generate particles from the formulation 52. The control circuit 16 may also be configured to operate the driver 55 at a rate such that the abrasive element 14 locally heats a portion of the formulation 52 through friction to a temperature sufficient to vaporize a volatile component of the formulation 52. The local heating may vaporize flavors which may add to the sensory perception (e.g., smell and taste) of the generated particle cloud. In effect, the abrasive element 14 may mechanically ablate particles from the formulation 52 and/or thermally vaporize other constituents of the formulation 52.

In at least one example embodiment, the control circuit 16 may operate the driver 55, such that the abrasive element 14 rotates, vibrates, and/or oscillates. The rotation, vibration, and/or oscillation may be constant or pulsed. The magnitude and/or the frequency of the pulsing may be used to control the local heating at the interface between the abrasive element 14 and the surface of the formulation 52, as well as the production of particles.

In at least one example embodiment, the control circuit 16 is configured also to adjust frequency, magnitude, and/or time period responsive to readings of battery voltage so that consistent performance is maintained as the voltage level of the power supply 1 declines during use.

In at least one example embodiment, the control circuit 16 may include a manually configured switch for an adult vaper to initiate a puff. The time-period and characteristics of the electric current supply to the driver 55 may be pre-set depending on the amount of particles desired to be generated. The control circuit 16 is pre-programmed or programmable for this purpose.

In at least one example embodiment, as shown in FIG. 1, the electronic inhalation device 60 may include a partition 110 at a location between the driver 55 and the abrasive element 14. The electronic inhalation device 60 may also include a seal 112. The shaft 53 may extend through the partition 110. Such arrangement protects the driver 55, the power source 1, and any associated control circuit 16 from stray particles generated adjacent the formulation 52.

In at least one example embodiment, as shown in FIGS. 2A, 2B, and 3-6, the electronic inhalation device 60 may include a disposable cartridge (first section) 70 and a reusable power supply component (battery section) 72. The cartridge 70 is connectable to the power supply component 72 at a connection 205 such as a threaded connection or by another convenience such as a snug-fit, detent, clamp, clasp, and/or magnetic connection.

The cartridge 70 includes an outer housing 6' (such as a cylindrical tube) which extends longitudinally and includes the air inlet 44. In at least one example embodiment, two or more air inlets 44 may be located at different locations along the length and/or around the circumference of the cartridge 70 of the electronic inhalation device 60. The size and number of air inlets 44 may be selected so as to establish a desired resistance to draw of the electronic inhalation device 60. In an embodiment, an air inlet 44 may be included in the power supply component 72.

Figure 2A:
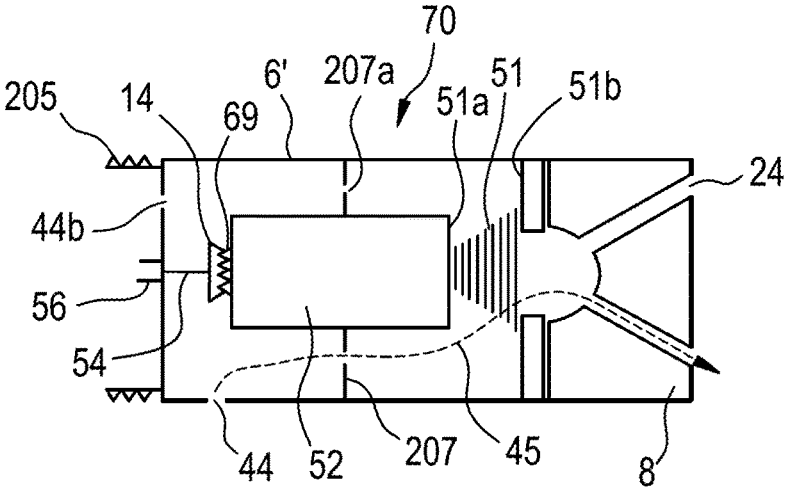
FIG. 2A is a cross-sectional view of a cartridge of an electronic inhalation device according to at least one example embodiment.

In at least one example embodiment, as shown in FIG. 2A, the cartridge 70 (first section) may include a mouth-end insert 8 having two or more, off-axis, diverging outlets 24. The mouth-end insert 8 is in fluid communication with the air inlet 44 along the airflow path 45. In at least one example embodiment, the airflow path 45 may extend through an air flow opening 207*a* of a support 207 which supports the formulation 52 in the cartridge 70 of the electronic inhalation device 60. At least a portion of the airflow path 45 is disposed adjacent the formulation 52 and/or the abrasive element 14, such that particles abraded (ablated) from the formulation 52 may be entrained into the airflow.

Figure 4:
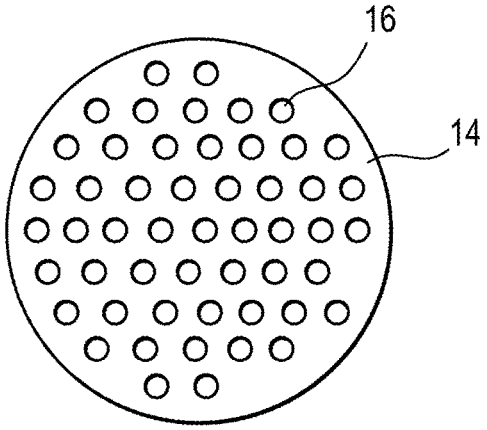
FIG. 4 is a top view of the disc-shaped abrasion element of FIG. 3.

In at least one example embodiment, the abrasive element 14 may be formed from stainless steel. The abrasive element 14 may include the roughened surface 69, which may include a plurality of teeth, bumps, grooves and/or nubs as shown in FIG. 4. The size, number, and spacing between the teeth, bumps, grooves and/or nubs may be selected based on a desired particle size to be generated. The roughened surface 69 of the abrasive element 14 may increase the coefficient of friction between the roughened surface 69 and a contacted surface of the formulation 52.

In at least one example embodiment, as shown in FIG. 4, the abrasive element 14 may be a disc with a roughened top surface 69 including the plurality of teeth, which faces an opposing (e.g., circular or annular) face or surface of the formulation 52.

Figure 2B:
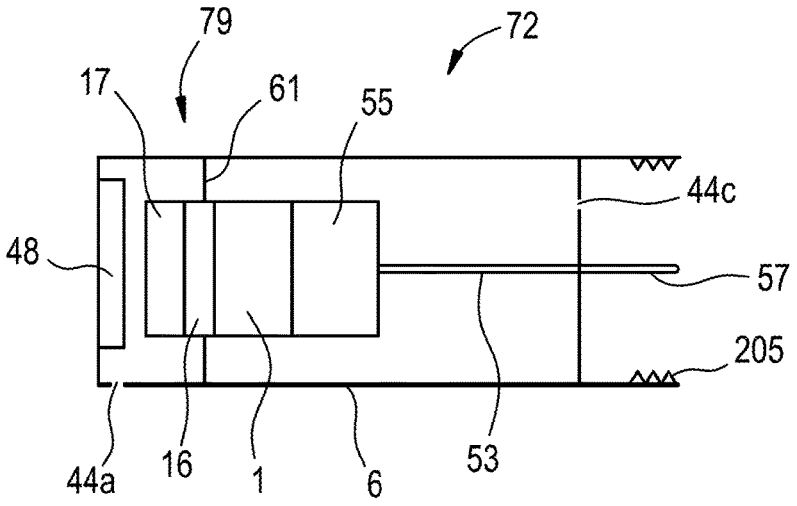
FIG. 2B is a cross-sectional view of a power supply component of an electronic inhalation device according to at least one example embodiment.

As shown in FIG. 2B, the power supply component 72 includes an outer housing 6 extending in a longitudinal direction, and includes the power source or battery 1 in electrical communication with the driver 55 through control circuit 16.

In at least one example embodiment, the control circuit 16 communicates responsively with a puff sensor (e.g., pressure sensor) 17 that is located at a distal end (portion) 79 of the power supply component 72. The puff sensor 17 is configured to generate a signal responsive to air being drawn through the electronic inhalation device 60 through the mouth-end insert 8. In response to the signal from the puff sensor 17, the control circuit 16 communicates a power cycle to the driver 55. The pressure drop of a draw (or puff) upon the mouth-end insert 8 of cartridge 70 may be communicated to the puff sensor 17 through openings 44*b* (shown in FIG. 2A) and 44*c* in components 70 and 72, respectively, adjacent the connection 205, and via spaces provided between the power supply 1 and adjacent portions of the housing 6. The puff sensor 17 is configured to generate more than one signal, such as a range of signals responsive to the magnitude of a puff or draw upon the electronic inhalation device 60 so that the control circuit 16 may discriminate between the signals to adjust the frequency, magnitude, and/or length of time of the immediate power cycle in response to the signal it receives from the puff sensor 17.

For example, a heavy draw on the electronic inhalation device 60 might generate a first signal from the puff sensor 17, which in turn may cause the control circuit to extend the time of the immediate power cycle responsively or make some other adjustment in the power cycle to provide a greater production of particles. In at least one example embodiment, the control circuit 16 may supply power to the driver 55 as long as the puff sensor 17 detects a pressure drop.

In at least one example embodiment, as shown in FIG. 2B, a partition 61 is provided at or near the puff sensor 17 to isolate a pressure relief inlet 44*a* which is located at the distal end 79 of the power supply component 72. The pressure relief inlet 44*a* serves to relieve pressure on one side of the puff sensor 17, which would otherwise interfere with facile operation of the puff sensor 17. In at least one example embodiment, the puff sensor 17 and control circuit 16 may be a single chip. The chip may be an integrated circuit with resistors and timing circuits, inputs and outputs which may function to cause switching (i.e., supply power from the power source to the induction source based on the puff sensor signal, and to cause an LED 48 to blink when power is low, and other functionalities.).

In at least one example embodiment, the control circuit 16 may also communicate power to the LED 48 to glow when the driver 55 is activated and/or a power cycle is executed. In at least one example embodiment, the LED 48 is at a distal end 79 of the electronic inhalation device 60 so that the LED 48 mimics the appearance of a burning coal during a puff. The LED 48 may be arranged so that its glow is visible to the adult vaper. In addition, the LED 48 may be utilized for system diagnostics. The LED 48 may also be configured, such that the vaper may activate and/or deactivate the LED 48 for privacy, such that the LED 48 would not activate during vaping if desired.

In at least one example embodiment, as shown in FIGS. 2A and 2B, the cartridge 70 may contain the abrasive element 14, an abrasion shaft 54, an abrasion shaft coupling 56, and the biasing element 51. The power supply component 72 may contain the drive shaft 53 and a drive shaft coupling 57.

In at least one example embodiment, as shown in FIGS. 2A and 2B, the abrasive element 14 is connected to the abrasion shaft 54, and the abrasion shaft 54 is connected to the abrasion shaft coupling 56. When the cartridge 70 is connected to the power supply component 72, the abrasion shaft coupling 56 is configured to detachably couple with the drive shaft coupling 57. The drive shaft coupling 57 is included at an end of a drive shaft 53, such that the driver 55 may drive the abrasive element 14 when the drive shaft coupling 57 is coupled to the abrasion shaft coupling 56 and the control circuit 16 directs power from the power supply 1 to the driver 55. The driver 55, which is in electrical communication with the control circuit 16 and power supply 1, is configured to rotate and/or oscillate the drive shaft 53 when the driver 55 is powered by the power supply 1. The abrasion shaft 54 rotates and/or oscillates the abrasive element 14 to generate a particle cloud from the formulation 52.

In at least one example embodiment, the drive shaft coupling 57 and/or the abrasion shaft coupling 56 may include any suitable type of coupling. The coupling may be a rigid coupling or a flexible coupling. For example, the coupling may include a sleeve coupling, a flange coupling, a clamp coupling, a bush pin type flange coupling, a beam coupling, or any other type of coupling. In at least one example embodiment, the drive shaft coupling 57 and/or the abrasion shaft coupling 56 include a pair of elements with threading (not shown), such that the drive shaft coupling 57 and the abrasion shaft coupling 56 may be attached and detached.

In at least one example embodiment, the biasing element 51 forces the formulation 52 and the abrasive element 14 toward each other such that sufficient contact between a roughened surface 69 of the abrasive element 14 and a surface of the formulation 52 is created and a particle cloud may be abrasively (ablatively) generated. In at least one example embodiment, as shown in FIG. 2A, the biasing element 51 may comprise a compression spring operative between an end portion 51*a* of the formulation 52 and a stop 51*b* located within the housing 6' adjacent the mouth-end insert 8.

Figure 3:
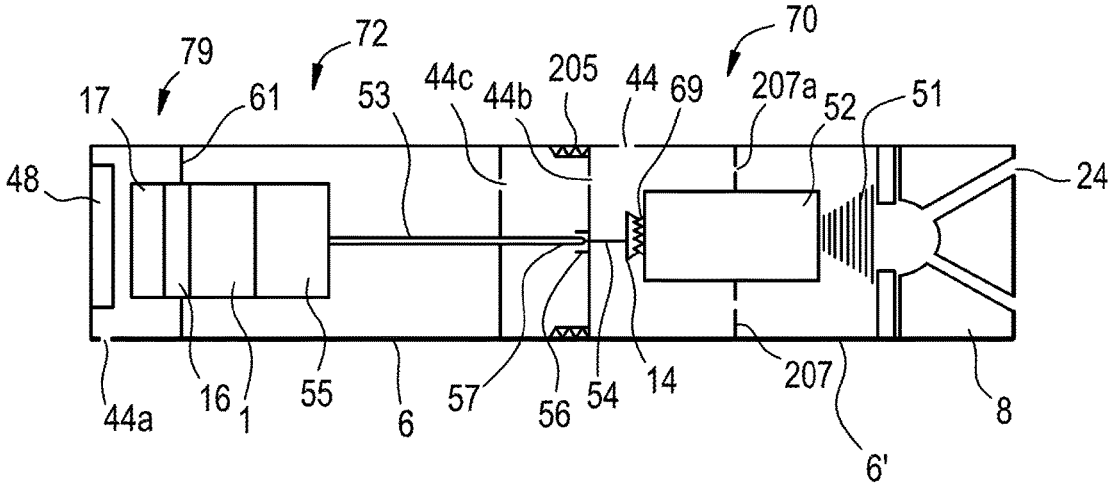
FIG. 3 is a cross-sectional view of an electronic inhalation device including a disc-shaped abrasion element according to at least one example embodiment.

In at least one example embodiment, as shown in FIG. 3, the cartridge of FIG. 2A may be connected to the power supply section of FIG. 2B to form the electronic inhalation device 60.

Figure 5:
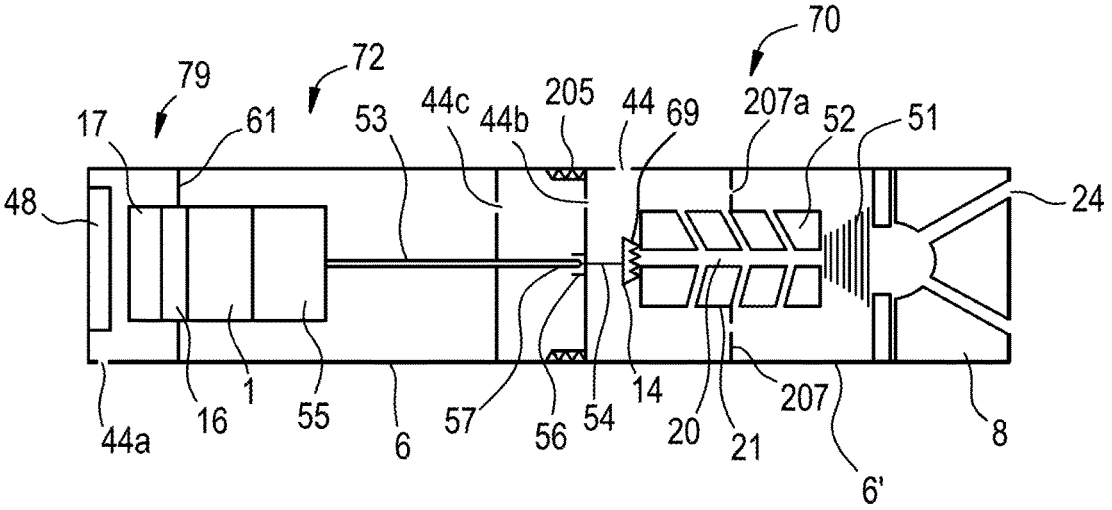
FIG. 5 is a cross-sectional view of an electronic inhalation device according to at least one example embodiment.

In at least one example embodiment, as shown in FIG. 5, the electronic inhalation device 60 is arranged the same as in FIGS. 2A and 2B except the formulation 52 includes a longitudinal (central) airflow passage 20 therethrough and a plurality of radial, off-axis airflow passages 21.

As shown in FIG. 5, the formulation 52 is a hollow body, and the hollowed out portion of the formulation 52 forms the longitudinal (central) airflow passage 20 therethrough. The formulation 52 may include the radial, off-axis airflow passages 21 in communication with the central air passage 20. The radial passages 21 may be sized and configured to facilitate transmission of air therethrough to promote entrainment of particles into the airstream. Particles which are abrasively removed from the formulation 52 by the abrasive element 14 may be entrained in an air stream which is drawn through the central airflow passage 20 during use of the electronic inhalation device.

In at least one example embodiment, the abrasive element 14 is connected to the drive shaft 53 such that the driver 55 included in the power supply component 72 may drive the abrasive element 14 when the control circuit 16 directs power from the power supply 1 to the driver 55. The driver 55, which is in electrical communication with the control circuit 16 and power supply 1, is configured to rotate and/or oscillate the drive shaft 53, such that the drive shaft 53 rotates and/or oscillates the abrasive element 14 to abrade the formulation 52 in the cartridge 70 when the power supply component 72 is connected to the cartridge 70. The biasing element 51 forces the formulation 52 and the abrasive element 14 toward each other, such that sufficient contact between a roughened surface 69 of the abrasive element 14 and a surface of the formulation 52 is created and a particle cloud may be abrasively generated.

Figure 6:
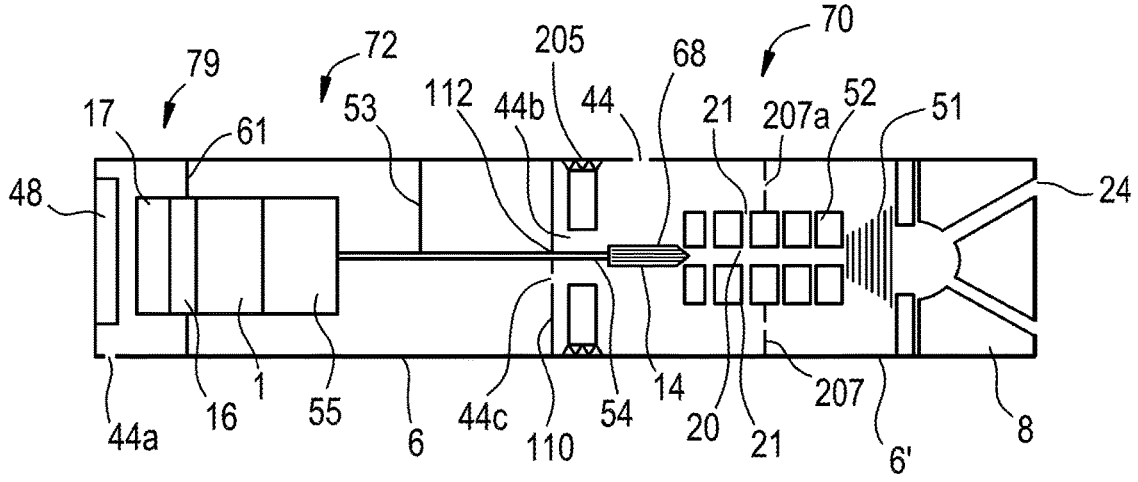
FIG. 6 is a cross-sectional view of an electronic inhalation device including an abrasion element including vanes according to at least one example embodiment.

In at least one example embodiment, as shown in FIG. 6, the electronic inhalation device 60 is arranged the same as in FIGS. 2A and 2B except that the abrasive element 14 includes vanes 68 and the formulation 52 includes a central airflow passage 20 and at least one radial passage 21, which is in fluid communication with the central airflow passage 20 and the air inlet 44.

Figure 7:
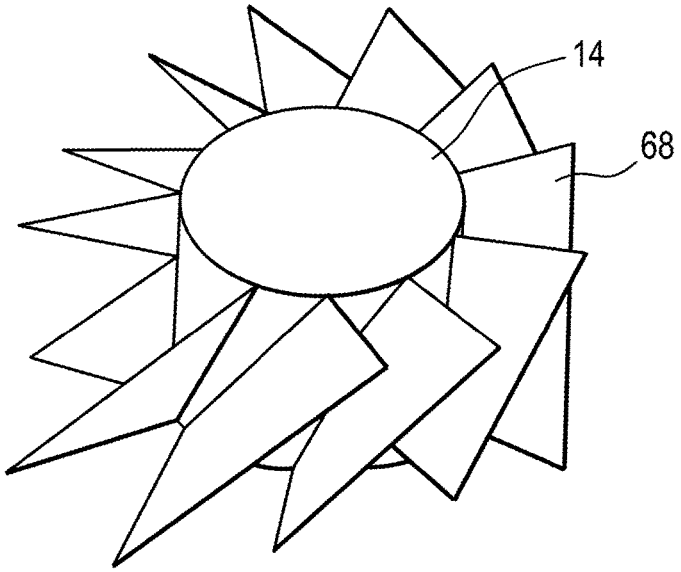
FIG. 7 is an enlarged, perspective view of the abrasion element including vanes of FIG. 6.

In at least one example embodiment, as shown in FIG. 6, the surface of the abrasive element 14 may include the vanes 68. For example, as shown in FIG. 6, the abrasive element 14 may include a drill bit which includes the vanes 68 on a surface thereof. In at least one example embodiment, as shown in FIG. 7, the vanes 68 are arranged on the surface of the abrasive element 14 so as to remove particles from the formulation 52, generate airflow, and direct the generated particle cloud toward the airflow path 45 within of the cartridge 70. In this manner, abrasively removed particles of the formulation 52 are directed toward an airstream of the airflow path 45 such that the abrasively removed particles forming the particle cloud become entrained in the air stream of the airflow path 45.

Figure 8:
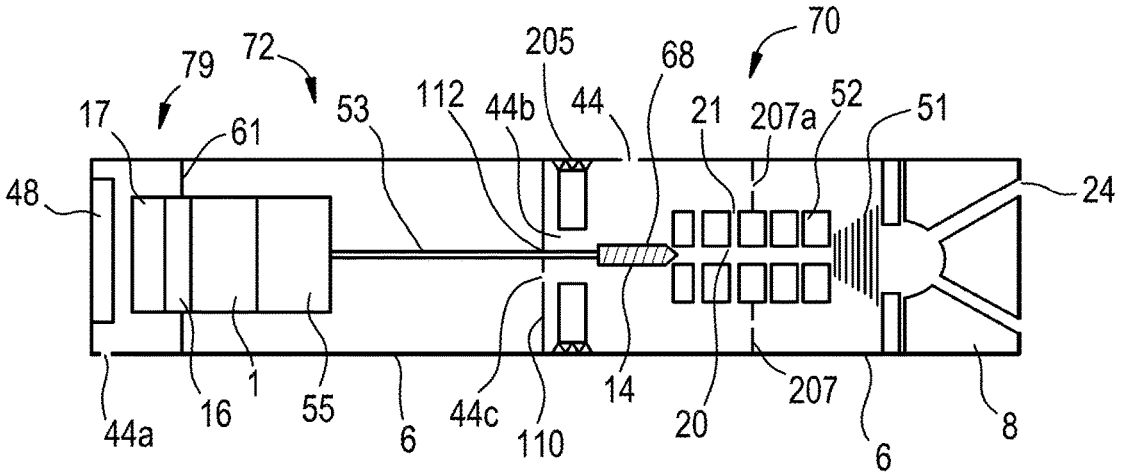
FIG. 8 is a cross-sectional view of an electronic inhalation device including an abrasion element in the form of a drill bit according to at least one example embodiment.
Figure 9A:
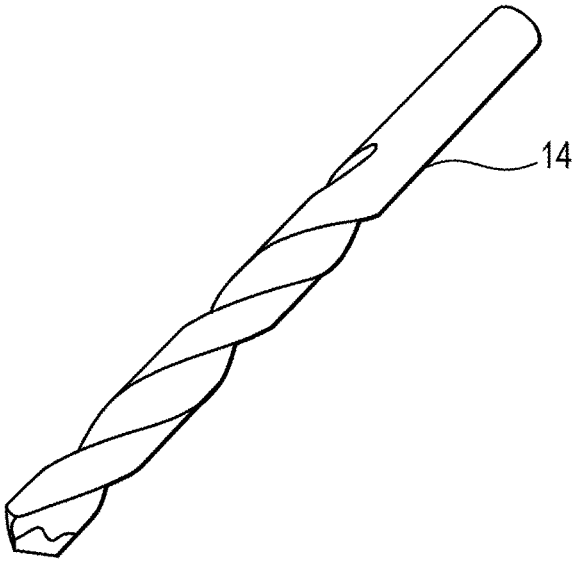
FIGS. 9A-9D are enlarged views of drill bits for use as abrasion elements in at least one example embodiment.
Figure 9B:
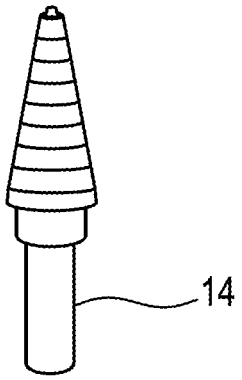
Figure 9C:
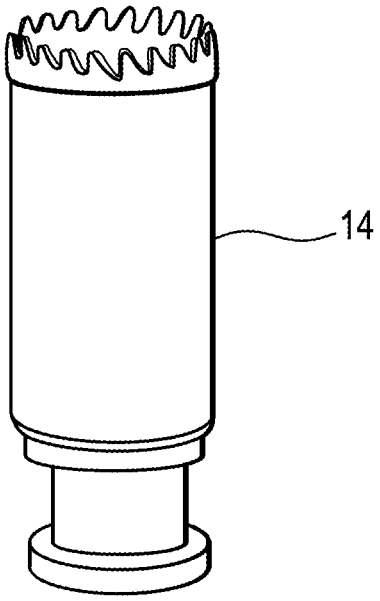
Figure 9D:
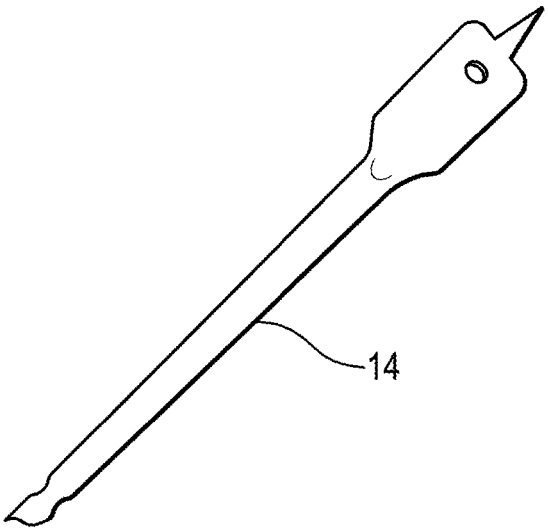

In at least one example embodiment, as shown in FIG. 8, the electronic inhalation device 60 is arranged the same as in FIGS. 2A and 2B except that the abrasive element 14 includes a drill bit. For example, as shown in FIGS. 9A-9D, the drill bit may be a twist drill bit, a step drill bit, a core drill bit, a spade drill bit, or any other suitable drill bit that can abrade particles from the formulation 52. The size and shape of the drill bit can be chosen depending on the size and shape of the formulation 52 and whether the formulation 52 is hollow or not.

In at least one example embodiment, the abrasive element 14 may be any element which is configured to abrasively remove particles from the formulation 52. In at least one example embodiment, the abrasive element 14 is configured to frictionally heat a portion of the formulation 52 such that a portion of the formulation 52 is abraded.

Figure 10:
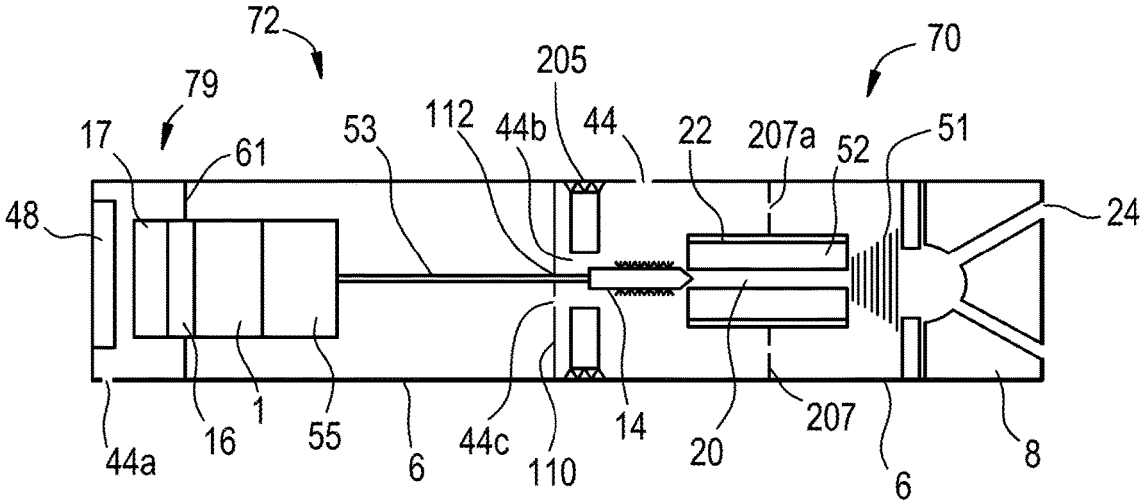
FIG. 10 is a cross-sectional view of an electronic inhalation device according to at least one example embodiment.

In at least one example embodiment, as shown in FIG. 10, the electronic inhalation device 60 is the same as that described with reference to FIGS. 2A, and 2B above except that the abrasive element 14 includes a wire bristle or wire brush and the formulation 52 includes an outer coating 22. The wire bristle or wire brush may have a drill bit at its leading end portion. The bristles may be formed of stainless steel, other metals, or plastics, and are firm enough to abrade the formulation 52. The bristles may range in length from about 0.1 mm to about 5.0 mm. The size and number of bristles can be chosen depending on the desired particle size of particles abraded from the formulation 52.

In at least one example embodiment, as shown in FIG. 10, the formulation 52 includes the protective outer coating 22 configured to reduce exposure of the underlying formulation 52 to humidity and/or oxygen.

Figure 11:
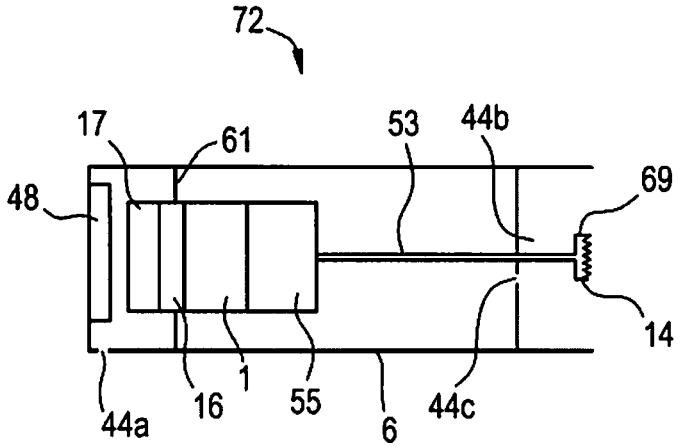
FIG. 11 is a cross-sectional view of a power section including an abrasion element according to at least one example embodiment.

In at least one example embodiment, as shown in FIG. 11, the electronic inhalation device 60 may be arranged the same as in FIGS. 2A and 2B except that the abrasive element 14 may be included in the power supply component 72 of the electronic inhalation device 60 rather than in the cartridge 70.

Figure 12:
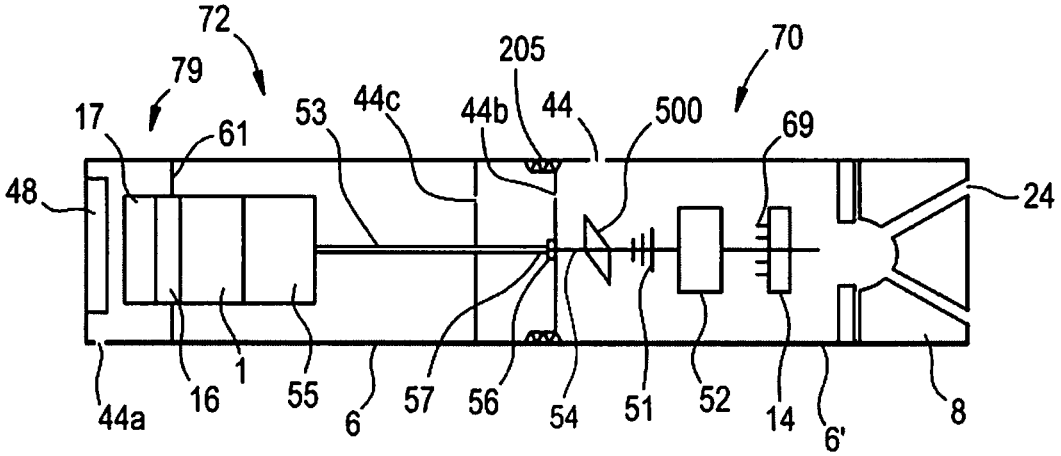
FIG. 12 is a cross-section view of an electronic inhalation device according to at least one example embodiment.

FIG. 12 is a cross-section view of an electronic inhalation device according to at least one example embodiment. In at least one example embodiment, as shown in FIG. 12, the electronic inhalation device 60 may be arranged the same as in FIGS. 2A and 2B except that the biasing element 51 is arranged between the formulation 52 and a fan 500, and the abrasive element 14 is between the formulation 52 and the mouth-end insert 8.

In at least one example embodiment, as shown in FIG. 12, the fan 500, biasing element 51, and the abrasive element 14 are connected to the abrasion shaft 54. The formulation 52 includes a hole through the formulation 52, such that the formulation 52 is held on the abrasion shaft 54, but is not connected thereto. The biasing element 51 maintains the formulation 52 close to, but not in contact with the abrasive element 14.

During vaping, the fan 500 blows the formulation 52 against the abrasive element 14, and the abrasive element 14 grinds the formulation 52 until then the grinding action pushes the formulation 52 away from the abrasive element 14. The fan 500 continues blowing the formulation 52 towards the abrasive element 14 so as to maintain and/or increase contact of the abrasive element 14 and the formulation 52. The intermittent grinding during vaping may help reduce torque required to grind the formulation 52 and/or help reduce stalling of the motor.

In at least one example embodiment, a method of producing a particle cloud from an electronic inhalation device 60 may include contacting an abrasive element surface, such as a roughened surface 69, of the abrasive element 14 with a surface of a formulation 52. A signal indicative of a puff may be generated by communicating a draw upon the electronic inhalation device 60 to the puff sensor 17 and a portion of the formulation 52 is abraded by driving the abrasive element surface of the abrasive element 14 against the surface of the formulation 52. The frictional force between the abrasive element surface of the abrasive element 14 and the surface of the formulation 52 abrasively removes particles from the surface of the formulation 52. The particles may be drawn through an airflow path 45 of the electronic inhalation device 60 and out the outlet 24.

In at least one example embodiment, the abrasive element 14 may be arranged so as to bore through a central region of the formulation 52, thereby leaving a shell which may be removed from the cartridge 70 of the electronic inhalation device 60 after a desired (or, alternatively a predetermined) amount of particles have been produced. In at least one example embodiment, the abrasive element 14 may be arranged such that only the protective outer coating 22 of the formulation 52 remains after a desired (or, alternatively a predetermined) amount of use of the electronic inhalation device 60.

It is to be understood that the particle cloud generated comprises a suspension of fine solids (particles). The mass mean aerodynamic diameter (MMAD) of these particles is about 1 micron to about 10 microns. In at least one example embodiment, the abrasive element 14 driven by the driver 55 is configured to frictionally heat at the contact point between the abrasive element 14 and the surface of the formulation 52 so as to abrade a component of the formulation 52. In at least one example embodiment, the abraded component includes nicotine.

In at least one example embodiment, a particle cloud is generated without use of resistance heaters, such as tiny heater coils. In at least one example embodiment, all electrical components may be located in the power supply component 72 without any of them appearing in the cartridge 70 itself. Additionally, the formulation 52 exhibits considerable stability over liquid formulations and is not prone to settling and provides an ease of manufacture over liquid formulations. The solid formulation 52 also avoids issues of leaking and does not require filling operations during manufacture of the cartridge.

In at least one example embodiment, the electronic inhalation device 60 may be in a size and form approximating a cigar or a pipe. It may also be in a form other than cylindrical, such as one having a square cross-section, or a triangular or rectangular cross-section.

Whereas the embodiments are described as being cylindrical, other suitable forms include right angular, triangular, oval, oblong, or other cross-sections.

It is to be realized that one may move the formulation 52 relative to a fixed abrading abrasive element 14 or move both. It is also envisioned that more than one abrasive element 14 and or more than one formulation 52 might be utilized to provide a balance of mechanical movement within the vaping article 60 and/or to provide a more complex particle cloud. The formulation 52 may include more than one longitudinal passage 20.

As used herein, the definition of the term "ablate" includes removal by cutting, erosion, melting, evaporation, and/or abrasion. Additionally, the definition of the term "ablate" may include removal by grinding and/or abrading.

It will now be apparent that a new, improved, and non-obvious electronic inhalation device has been described in this specification with sufficient particularity as to be understood by one of ordinary skill in the art. Moreover, it will be apparent to those skilled in the art that modifications, variations, substitutions, and equivalents exist for features of the electronic inhalation device which do not materially depart from the spirit and scope of the embodiments disclosed herein. Accordingly, it is expressly intended that all such modifications, variations, substitutions, and equivalents which fall within the spirit and scope of the invention as defined by the appended claims shall be embraced by the appended claims.

I claim:

1. A cartridge of an electronic inhalation device, the cartridge comprising:

an outer housing extending in a longitudinal direction;

an air inlet;

an outlet;

an airflow path communicating the air inlet and the outlet;

a formulation in the outer housing and at least partially between the air inlet and the outlet, the formulation including a solid material comprising a body and a hole through the body;

an abrasive element;

a biasing element;

a fan; and an abrasion shaft;

wherein the hole through the body is configured hold the formulation on the abrasion shaft such that the formulation is configured to move along the abrasion shaft by the fan;

wherein the abrasive element, the biasing element, and the fan are connected to the abrasion shaft such that the biasing element maintains a distance between the formulation and the fan and a distance between the formulation and the abrasive element;

wherein the fan is configured to urge the formulation toward and into contact with the abrasive element; and wherein the abrasive element is configured to abrasively remove particles from the formulation when the formulation is urged into contact with the abrasive element such that the particles become entrained in an air stream of the airflow path.

2. The cartridge of claim 1, wherein the abrasion shaft is configured to couple to and be driven by a drive shaft of the electronic inhalation device, and wherein the drive shaft is driven by a driver.

3. The cartridge of claim 2, wherein the abrasion shaft includes an abrasion shaft coupling configured to detachably couple to a drive shaft coupling.

4. The cartridge of claim 1, further comprising:

a filter between the formulation and the outlet.

5. The cartridge of claim 1, wherein the biasing element includes at least one of a spring or an elastic material.

6. The cartridge of claim 1, wherein the abrasive element is formed from stainless steel.

7. The cartridge of claim 1, wherein the abrasive element includes at least one of a roughened surface, vanes arranged on a surface of the abrasive element, a drill bit, a wire bristle, a wire brush having a drill bit at a leading end portion thereof, a sub-combination thereof, or a combination thereof.

8. The cartridge of claim 7, wherein the drill bit includes at least one of a twist drill bit, a step drill bit, a core drill bit, or a spade drill bit.

9. The cartridge of claim 1, wherein the formulation includes at least one of nicotine, a nicotine salt, a sugar, a sugar alcohol sweetener, nicotine bitartrate, a flavor, a binder, a crystalline acid, a filler, a sub-combination thereof, or a combination thereof.

10. The cartridge of claim 1, wherein the body of the formulation is cylindrical in shape.

11. The cartridge of claim 1, wherein the formulation includes a protective outer coating.

12. The cartridge of claim 1, wherein the abrasive element is configured to heat a portion of the formulation by friction.

13. The cartridge of claim 1, further comprising:

a recloseable loading port configured to allow the formulation to be inserted and removed from the cartridge.

14. The cartridge of claim 1, wherein the fan is configured to blow the particles towards the outlet.

15. An electronic inhalation device comprising:

an outer housing extending in a longitudinal direction;

an air inlet;

an outlet;

an airflow path communicating the air inlet and the outlet;

a formulation in the outer housing between the air inlet and the outlet, the formulation including a solid material comprising a body and a hole through the body;

an abrasive element;

a biasing element;

a fan;

an abrasion shaft;

a power supply; and a driver in electrical communication with the power supply, the driver configured to drive the abrasion shaft;

wherein the hole through the body is configured hold the formulation on the abrasion shaft such that the formulation is configured to move along the abrasion shaft by the fan;

wherein the abrasive element, the biasing element, and the fan are connected to the abrasion shaft such that the biasing element maintains a distance between the formulation and the fan and a distance between the formulation and the abrasive element;

wherein the fan is configured to urge the formulation toward and into contact with the abrasive element; and wherein the abrasive element is configured to abrasively remove particles from the formulation when the formulation is urged into contact with the abrasive element such that the particles become entrained in an air stream of the airflow path and form a particle cloud.

16. A method of producing a particle cloud from an electronic inhalation device, comprising:

providing an electronic inhalation device comprising:

an outer housing extending in a longitudinal direction;

an air inlet;

an outlet;

an airflow path communicating the air inlet and the outlet;

a solid formulation agent in the outer housing and at least partially between the air inlet and the outlet, the solid formulation agent comprising a body and a hole through the body;

an abrasive element;

a biasing element;

a fan;

an abrasion shaft;

a power supply; and a driver in electrical communication with the power supply, the driver configured to drive the abrasion shaft;

wherein the hole through the body is configured hold the solid formulation agent on the abrasion shaft such that the solid formulation agent is configured to move along the abrasion shaft by the fan; and wherein the abrasive element, the biasing element, and the fan are connected to the abrasion shaft such that the biasing element maintains a distance between the solid formulation agent and the fan and a distance between the solid formulation agent and the abrasive element;

urging the solid formulation agent towards and into contact with the abrasive element using the fan, and abrading a portion of the solid formulation agent by driving the abrasive element against a surface of the solid formulation agent, wherein a frictional force between an abrasive element surface and the surface of the solid formulation agent removes particles from the surface of the solid formulation agent to form a particle cloud.

17. The method of claim 16, wherein the abrading includes locally heating the surface of the solid formulation agent with the abrasive element.

18. The method of claim 16, wherein the particles have a mass median aerodynamic diameter of about 1 micron to about 10 microns.

* * * * *